United States Patent [19]

Bonner

[11] 4,175,604

[45] Nov. 27, 1979

[54] TAMPER PROOF SECURITY MAIL AND BANK COLLECTION BAG

[76] Inventor: Cletus D. Bonner, 328 Beaver St., Beaver, Pa. 15009

[21] Appl. No.: 958,374

[22] Filed: Nov. 7, 1978

[51] Int. Cl.[2] ..... B65D 33/34

[52] U.S. Cl. ..... 150/15; 150/23; 70/65

[58] Field of Search ..... 150/15, 23; 70/64, 65

[56] References Cited

U.S. PATENT DOCUMENTS

| | | | |
|---|---|---|---|
| 477,963 | 6/1892 | Shaw | 150/23 |
| 602,723 | 4/1898 | Brown | 150/15 |
| 651,256 | 6/1900 | May | 150/15 |

FOREIGN PATENT DOCUMENTS

| | | | |
|---|---|---|---|
| 101517 | 7/1937 | Australia | 150/15 |
| 566868 | 9/1957 | Italy | 150/23 |
| 5461 | 12/1896 | Norway | 150/15 |

*Primary Examiner*—Ro E. Hart
*Attorney, Agent, or Firm*—W. Britton Moore

[57] ABSTRACT

Tamper proof security mail and bag collection bag including front and rear wall panels and gusseted side walls wherein the mouth end of the front panel is reinforced with steel plates and terminates below the reinforced plated rear wall, and the latter has spaced clevis pins therein and a pair of foldable reinforced plated wing members formed thereon and foldable relative thereto, with the gussets, wing members and front panel having grommeted eyelets therein alignable with the clevis pins enabling the wing members to be folded inwardly and the mouth end of the rear panel and the wing members to be single folded downwardly over the front panel so that the clevis pins project through the eyelets and receive padlock means for securing the bag mouth and gussets in closed untampering position. The plates in the front panel are midway spaced apart and enable this wall to be moved outwardly, when unlocked, to provide a large fully expanded V-shaped opening for the entry and removal of bag contents therethrough.

7 Claims, 12 Drawing Figures

TAMPER PROOF SECURITY MAIL AND BANK COLLECTION BAG

This invention relates to a tamper proof and lockable mail and bank security bag wherein the mouth is openable to provide a large fully expanded V-shaped opening which is so foldable and locked that tampering therewith is prevented.

While various locked night depository bags having folded and locked mouths have heretofore been proposed, such as those represented by U.S. Pat. Nos. to Strayer 1,748,529—2/25/30; 1,803,217—4/28/31; 2,136,598—11/15/38; and 3,200,868—8/17/65; these bags were essentially designed for bank night depository use and are too small and are not adaptable for use by financial institutions and agencies required to collect mail and money from various branches or collection points. Furthermore, and perhaps of more importance, these bags are susceptible to unauthorized tampering and pilfering of the contents without leaving any trace of such entry.

The principal object of the present invention is to provide a tamper proof, lockable, gusseted bag wherein the mouth is so reinforced and foldable for locking and fully expandable into opened position that tampering therewith and unauthorized entry thereof is prevented.

Another object is the provision of a security mail and collection bag particularly suited for use by financial institutions and agencies required to make currency and coin collections and wherein the bag mouth has gusseted sides and a single fold down top with reinforcing plates, clevis pins, and grommeted eyelets which enable the mouth to be securely closed and locked against unauthorized tampering and entry.

Still another object is to provide a gusseted security mail and bank collection bag having the rear wall formed with a single fold top at the mouth end thereof and two hinged foldable wings with flat reinforcing plates therein.

A further object is the provision of a gusseted bag wherein the front and rear wall panels thereof are formed with metal plate reinforced flaps at the mouth end with the flap on one wall projecting beyond the other flap and foldable downwardly thereover so that clevis pins on the first flap extend through grommeted eyelets in the gussets and second flap and retain the mouth in securely closed position.

Still a further object is to provide a gusseted bag having reinforced flaps at the mouth end thereof wherein the reinforcing plates in one flap are spaced apart to enable that flap to be expanded into generally V-shape wide and fully open position to facilitate entry and removal of the bag contents.

A still further object is the provision of a gusseted bag wherein the front and rear panels are formed with reinforced flaps at the mouth end with the flap on one panel having foldable reinforced and eyeleted wings, and the other flap and gussets being eyeleted so that, when the first flap and wings are single folded over the second flap, clevis pins on the first flap will project through the eyelets in the wings, gussets and second flap and enable the flaps to be secured in closed position so that the corners and other mouth areas cannot be surreptitiously disturbed to gain unauthorized entry without damaging the bag and leaving traces of such entry.

These and other objects and advantages will be apparent as the specification is considered with the accompanying drawings, wherein FIG. 1 is a perspective view of the tamper proof bag in fully closed and padlocked position;

Figure 1:
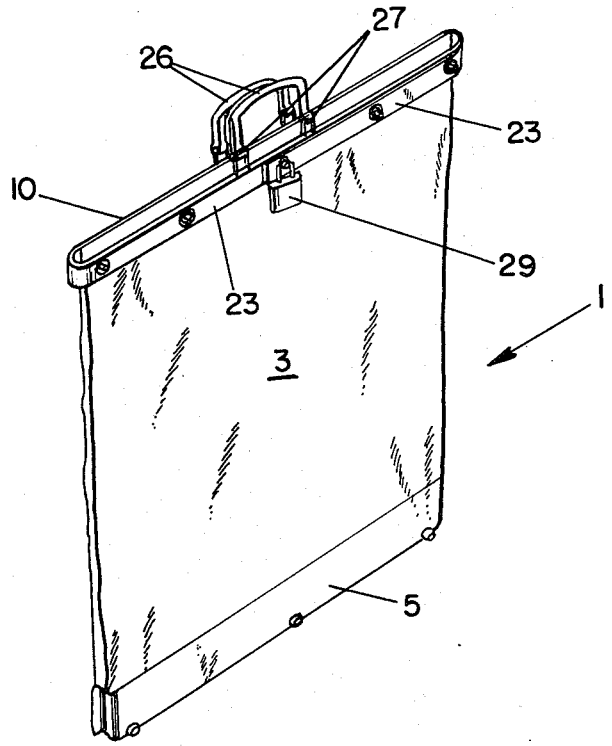
Figure 2:
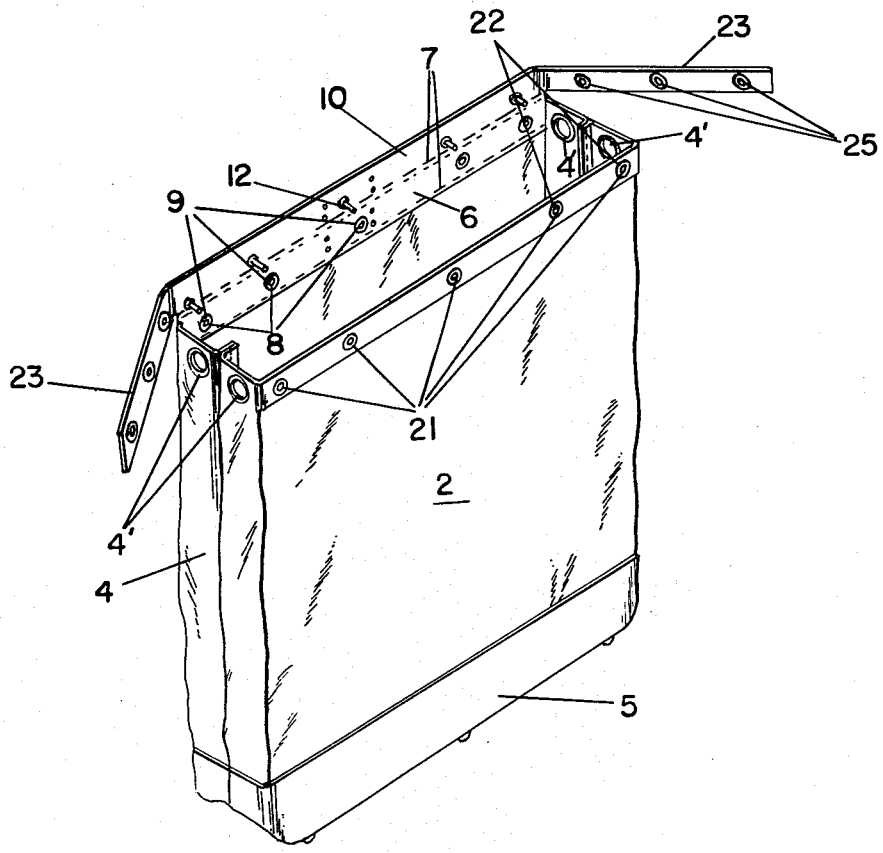
FIG. 2 is a perspective view of the gusseted bag with the flapped mouth end partially expanded to provide a generally narrow rectangular opening.
Figure 3:
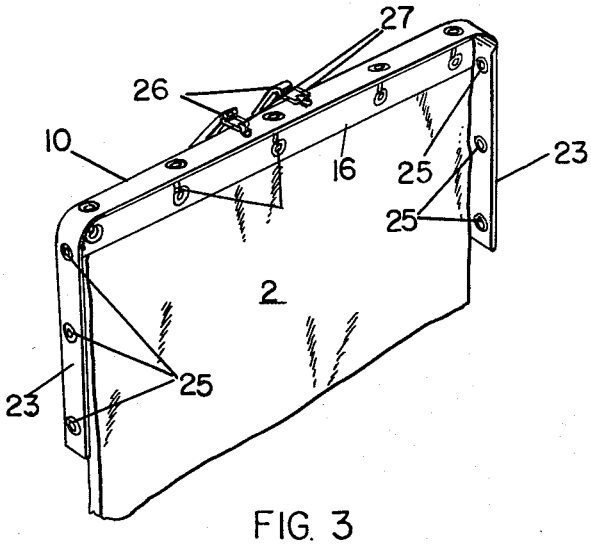
FIG. 3 is a perspective view of the mouth end of the bag showing the panel flap being folded over the other panel strip and with the wings on the flap depending downwardly thereof before being folded inwardly.
Figure 4:
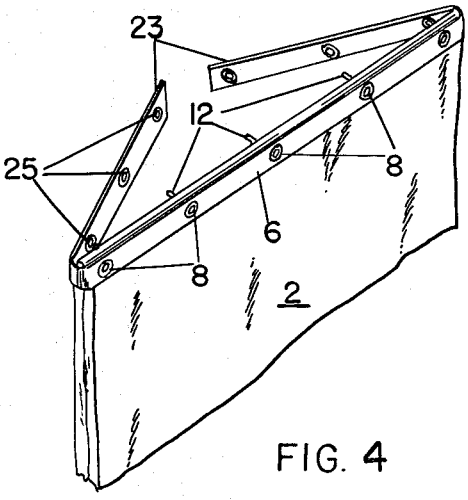
FIG. 4 is a perspective view, similar to FIG. 3, showing the flap in folded position and the wings being folded inwardly relative thereto.
Figure 5:
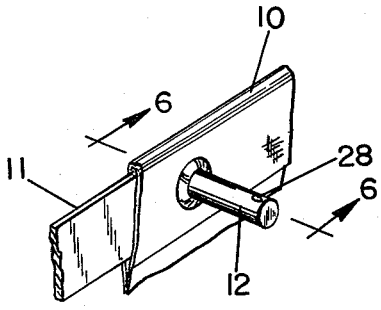
FIG. 5 is a perspective view of one of the clevis pins on the flap.

Referring more particularly to the drawings, wherein similar reference characters designate like parts throughout the several views, numeral 1 generally identifies the body of a bag which may be of any suitable material, such as, canvas, leather, or plastic, and includes a front and rear wall panels 2 and 3, and gussets 4 formed when the panels are stitched or other-wise secured together. A pair of grommeted eyelets 4' are formed in each of the gussets 4. The lower end of the bag is suitably reinforced and closed, as at 5.

The mouth end of one panel, such as rear panel 3, is covered and reinforced by a double or hollow flat strip 6 of some suitable material, such as plastic, which flatly overlies the inner and outer surfaces thereof and is suitably secured thereto by stitching or the like 7 so as to extend below and thereacross from gusset to gusset to strengthen and reinforce the mouth end of panel 3. Strip 6 and panel 3, interposed therebetween, are provided with a row of alined spaced enlarged eyelets 8 with reinforcing grommets 9 therein. While five eyelets are illustrated, this may be varied, if desired. The upper end of strip 6 projects upwardly beyond the mouth edge of panel 3 to provide a flat downwardly foldable flap 10 of approximately the same width as strip 6, and disposed within flap 10 and extending lengthwise thereof is a flat metal reinforcing plate 11. A row of alined spaced clevis pins 12, which may be five in number to correspond to the eyelets 8, project through and are suitably fixedly secured or anchored by eyelets 13' and washers 13" in spaced apertures 13 (FIG. 6) in the rear wall of the flap 10 and project through alined openings 14 in reinforcing plate 11 and grommeted eyelets 15 in the front wall of the flap.

The upper end of front wall panel 2 is similarly covered and reinforced by a double or hollow flat strip 16, of the same material and alined with the base or lower portion of the strip 6 on rear panel 3 and is secured to the front panel by stitching 17 so as to extend thereacross and therebelow from gusset to gusset opposing strip 6. The upper edge portion of the front wall panel is interposed between and covered by strip 16 and a pair of metal reinforcing plates 18 and 19 flatly engage wall panel 2 but are spaced apart at their mating inner ends, as at 20, to provide a hinging point therebetween. Strip 16, plates 18–19 and the panel are secured together by a row of five alined spaced enlarged eyelets 21 formed therein and extending therethrough and reinforced by grommets 22, but permit of the mouth end of the front panel folding or bending in its mid portion to effect an enlarged opening, as presently will be described. Thus, the grommeted eyelets 21 in front panel 2 correspond in size and are alinable with the grommeted eyelets 8 in rear panel reinforcing strip 6, when the bag mouth is in the closed position of FIG. 1, and the end grommeted eyelets 21 and 15 in the front and rear panel strips 16 and 6 are alined with the pair of grommeted eyelets 4' (FIG. 11) in each of gussets 4 when the latter are collapsed, as in FIG. 1.

Integrally formed on and extending laterally from each end of rear panel flap 10 is a wing 23 of the same width as the flap. Arranged within each wing is a flat metal reinforcing plate 24, similar to plate 11 in the flap, and each wing and plate is formed with a row of three alined spaced grommeted eyelets 25, smaller in diameter than the eyelets provided in reinforcing strips 6 and 16 but sufficiently large to be received by the clevis pins 12, as presently described. The inner ends of each wing reinforcing plate 24 is spaced from the outer ends of flap reinforcing plate 11 so that the wings may flex or hinge thereat and be foldable into flat overlapping positions relative to the flap, as will hereinafter be apparent. A pair of handles 26 are pivotally attached to clips 27, suitably mounted in the rear wall of the flap 10 and strip 6, on either side of the centermost clevis pin and grommeted eyelet, and enable the bag to be carried and handled in an obvious manner.

Figure 11:
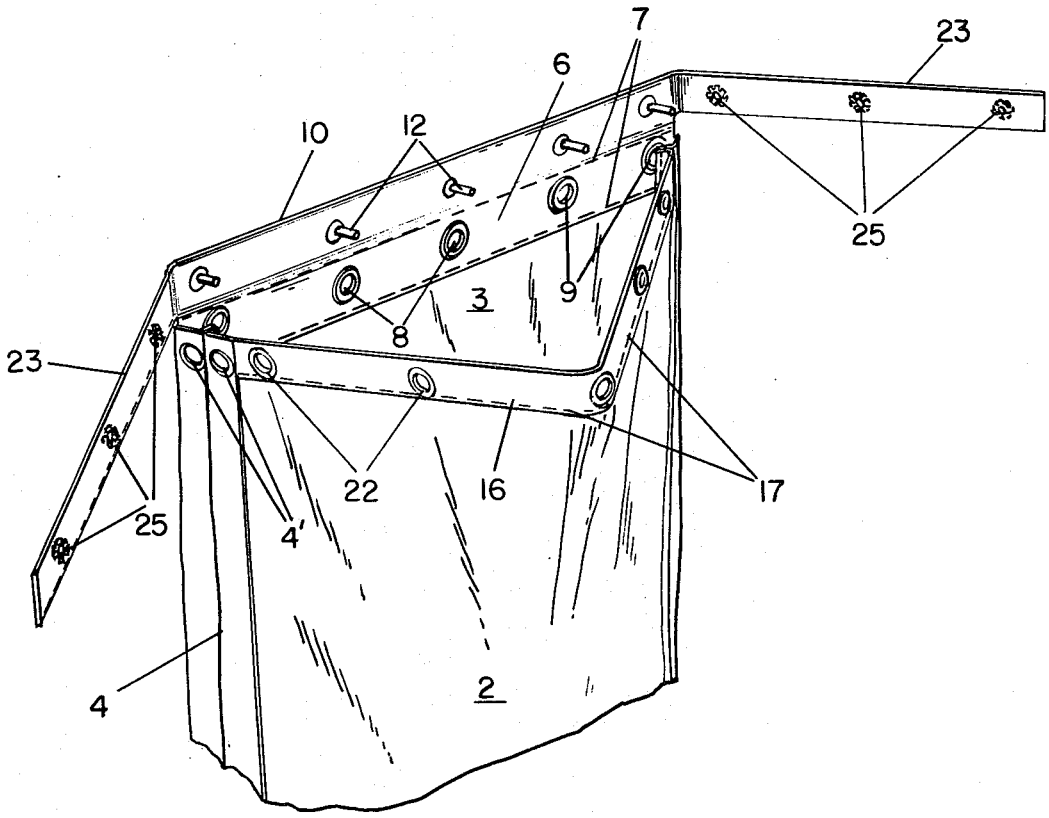
FIG. 11 is a perspective view, similar to FIG. 1, with the reinforced flap being fully expanded into generally V-shape and fully open position.
Figure 12:
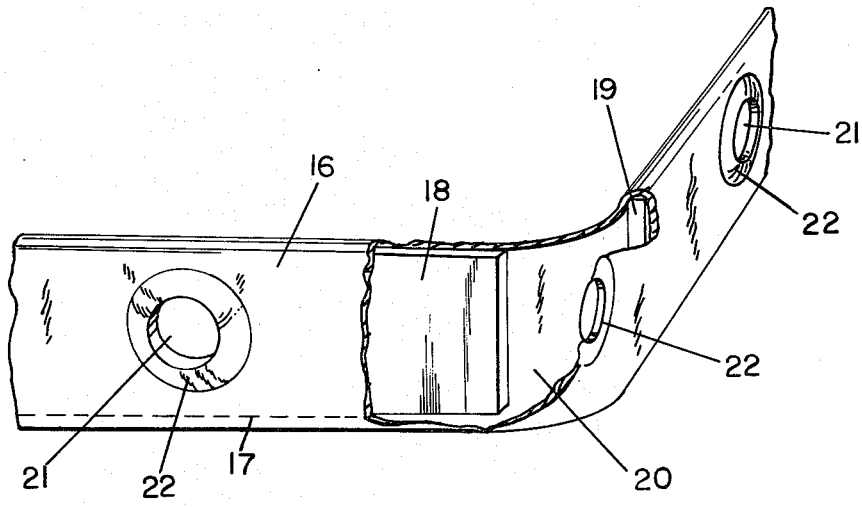
FIG. 12 is a perspective view of the reinforced and bendable flap, with metal reinforcing plates therein, when in the fully open position of FIG. 11.

When the bag mouth is in the fully open position of FIG. 11, gussets 4 are fully extended and the reinforced front panel strip 16 has been hinged in its mid section and moved outwardly into V-formation so that the rear panel strip 6 and flap 10 thereon project upwardly and the wings 23 formed thereon extend laterally and/or rearwardly. In this position, entry into and withdrawal from the bag may be effected with ease. The bag mouth may then be closed by collapsing the gussets and moving the front panel strip inwardly until it flatly engages the rear panel strip 6, and the five enlarged grommeted eyelets 21 and 9 in each are alined. As flap 10 projects upwardly above front panel strip 16, the flap is next single folded forwardly and downwardly so that clevis pins 12 may be projected rearwardly through the alined eyelets 21 and 9, and the inner side of the flap will flatly engage the outer face of front panel strip 16. The wings 23 on flap 10 are then folded rearwardly and inwardly into the flat overlapping position of FIG. 1, with the clevis pins extending through the grommeted eyelets 25 therein. It will be noted that the center clevis pin 12 projects through the grommeted eyelets in the overlapped ends of the wings, and the clevis pins on either side thereof extend through the grommeted eyelets in the respective wings. Each of the clevis pins 12 are apertured adjacent their outer ends, as at 28, for the reception of padlocks 29. While each pin, or several pins, may be padlocked for additional security, it is usually only necessary to apply a single padlock to the center clevis pin, as shown in FIG. 1.

Figure 6:
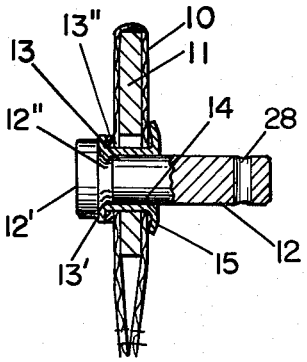
FIG. 6 is a section on the line 6—6 of FIG. 5.
Figure 7:
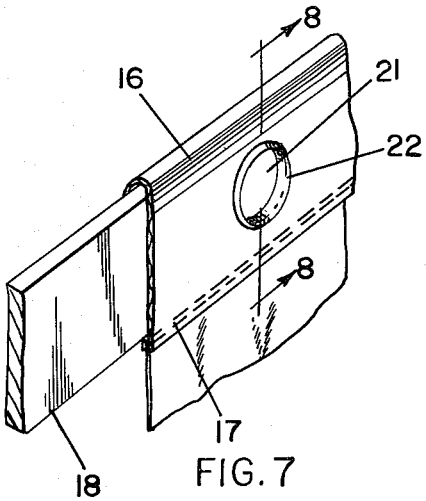
FIG. 7 is a perspective view of the front panel strip and one of the metal reinforcing plates and grommeted eyelets therein.
Figure 8:
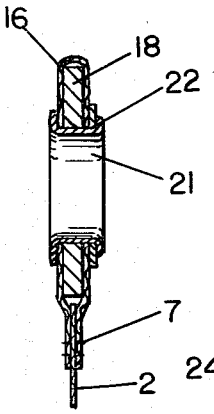
FIG. 8 is a section on the line 8—8 of FIG. 7.
Figure 9:
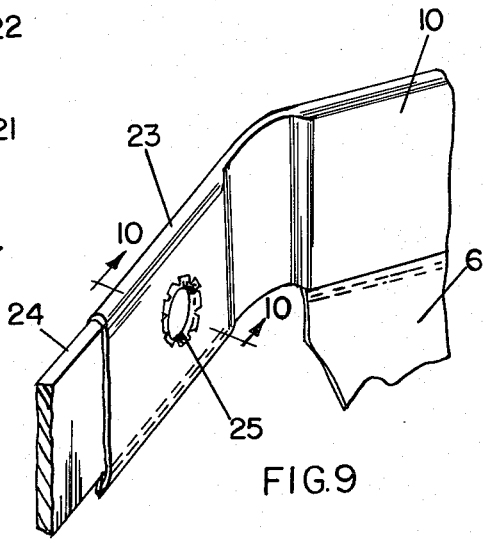
FIG. 9 is a perspective view of the flap and a portion of a reinforced and eyeleted wing thereon.
Figure 10:
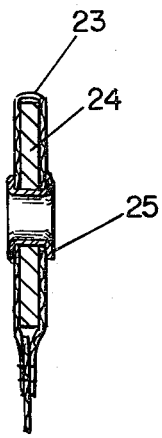
FIG. 10 is a section on the line 10—10 of FIG. 9.

It is important to note that the clevis pins 12 project through each of the grommeted eyelets in the front and rear panel reinforcing strips 16 and 6, and thence through the smaller diameter grommeted eyelets 25 in wings 23, so that the mouth end of the bag is secured entirely thereacross, including the gussets 4. The grommets in each of the eyelets preclude prying therethrough with a sharp or pointed instrument to gain unauthorized entry into the bag, without damaging the bag and leaving traces of such entry. In addition, and as best shown in FIG. 6, each clevis pin 12 is formed with an enlarged flat head 12' and an annular groove 12'' adjacent thereto which receives the anchoring grommet therein and enables the head to flatly bear thereagainst, which precludes prying of the clevis pins from the eyelets. It is of the utmost importance that the mouth end of the bag be securely closed and locked, because the users of collection type bags frequently encounter situations where bags are surreptitiously opened and the contents removed therefrom without leaving any trace of such entry, thus making it virtually impossible to pinpoint how and by whom the theft was effected. In addition, it has previously been possible for the top corners of the gusseted sides to be pulled outwardly and downwardly from the locked mouth enabling entry to be gained through the opening formed thereby and the contents extracted therethrough. This is not possible with the bag hereof because the endmost clevis pins 12 also project through the gusset grommeted eyelets 4' and securely retain the gussets together in closed collapsed positions and prevent them from being pulled away from the main bag body.

Inasmuch as the double flat strip 6, reinforced with spaced plates 18–19, is attached to the upper end of the front panel 2, and the double flat strip 6 is attached to the upper end of rear panel 3, the foldable plate reinforced flap 10 thereon projects above strip 6 and is foldable thereover in a single fold. Thus, when the plate reinforced wings 23 are folded inwardly relative thereto, the bag mouth is fully reinforced and closed, and provides a more secure and tamper proof closure, which is particularly desirable where large size bags are required.

While a preferred embodiment of tamper proof security mail and bank collection bag has been shown and described, it is to be understood that various changes and improvements may be made without departing from the scope and spirit of the appended claims.

What I claim is:

1. A tamper proof security mail and collection bag comprising front and rear wall panels, inwardly foldable gussets forming end walls, flat strip means secured to the mouth end of said front wall and having spaced flat reinforcing plate means associated therewith to enable hinging of said strip means in the mid section thereof, flat strip means secured to the mouth end of said rear wall, flat foldable flap means formed on said rear strip means having reinforcing plate means associated therewith, spaced apertured pins mounted on said flap means and projecting angularly therefrom, wing members foldably connected to said flap means and extending laterally from opposing ends thereof, reinforcing plate means associated with said members, spaced apertures in said front and rear strip means, gussets and wing members whereby when said mouth is closed, said flap means is single folded over said front strip means to project said pins through the apertures in both of said strip means, and said wing members are folded inwardly relative to said strip means with said pins projecting through the apertures therein, and locking means associated with at least one of said apertured pins for flatly closing and securing the mouth end of the bag against tampering and unauthorized opening, and whereby when said mouth is open said reinforced front strip means will hinge midway and be movable outwardly to form an enlarged generally V-shaped opening.

2. A bag according to claim 1, wherein said strip means and said flap means extend across the mouth end of the bag from gusset to gusset, and said flap means is coextensive therewith, and said wing members are foldable inwardly and overlappingly when said mouth is closed.

3. A bag according to claim 2, wherein said strip means is attached to the inner and outer surfaces of said wall panels at the mouth end thereof, and said reinforcing plate means is arranged in said strip and flap means with the spaced apertures in said strip and flap means and said wing members extending through said reinforcing plate means.

4. A bag according to claim 3, wherein said spaced apertures have reinforcing grommets therein, and said plate means extend longitudinally of said strip and flap means and said wing members.

5. A bag according to claim 4, wherein said apertures in said strips, flap and wing members are alined, and said pins are anchored in said flap and extend at right angles relative thereto to project through said alined apertures when said flap is single folded over said front panel strip and said wing members are folded inwardly into overlapping relation to said flap.

6. A bag according to claim 5, wherein said pins are clevis and are apertured at their outer ends for receiving said locking means therein, and the inner ends of said clevis pins are flat headed and annularly grooved, and said headed pins are anchored in spaced apertures in said flap means and are retained therein by metal eyelet and washer means.

7. A bag according to claim 6, wherein said locking means is a padlock.

* * * * *